US010808378B2

(12) United States Patent
Ness

(10) Patent No.: US 10,808,378 B2
(45) Date of Patent: Oct. 20, 2020

(54) TOOL-TO-CARRIER CRADLE ASSEMBLY

(71) Applicant: Stanley Black & Decker, Inc., New Britain, CT (US)

(72) Inventor: Reuben D. Ness, Mulino, OR (US)

(73) Assignee: Stanley Black & Decker, Inc., New Britain, CT (US)

( * ) Notice: Subject to any disclaimer, the term of this patent is extended or adjusted under 35 U.S.C. 154(b) by 305 days.

(21) Appl. No.: 15/421,178

(22) Filed: Jan. 31, 2017

(65) Prior Publication Data

US 2018/0216313 A1 Aug. 2, 2018

(51) Int. Cl.
*E02F 3/96* (2006.01)
*E02F 3/36* (2006.01)

(52) U.S. Cl.
CPC ..... *E02F 3/966* (2013.01); *E02F 3/3686* (2013.01)

(58) Field of Classification Search
CPC ..... E02F 3/966; E02F 3/3686; B25D 17/32; B25D 17/28
USPC ..... 173/184
See application file for complete search history.

(56) References Cited

U.S. PATENT DOCUMENTS 2,322,115 A * 6/1943 Cox ..... E02F 5/32 172/834
2,688,233 A * 9/1954 Craig ..... E04H 17/263 173/25
2,774,155 A * 12/1956 Hipp ..... E02F 3/8152 172/145
2,983,496 A 5/1961 Grant
3,235,013 A * 2/1966 Kirkpatrick, Jr. ..... A01B 51/00 172/413
3,427,735 A * 2/1969 Martin ..... E02F 3/653 37/412
3,672,521 A 6/1972 Bauer et al.
(Continued)

FOREIGN PATENT DOCUMENTS

GB 2103523 A 2/1983

OTHER PUBLICATIONS

Stanley MB656 Mounted Hydraulic Breaker User Manual, Safety, Operation and Maintenance, Jan. 2017 Ver. 12, http://www.stanleyhydraulics.com/sites/stanleyhydraulic.com/files/pdf/MB656%20User%20Manual%201-2017%20V12.
(Continued)

*Primary Examiner* — Thanh K Truong
*Assistant Examiner* — Katie L Gerth
(74) *Attorney, Agent, or Firm* — Harness, Dickey & Pierce, P.L.C.

(57) ABSTRACT

A tool and cradle assembly coupleable to a carrier, the assembly including a backplate coupleable to the carrier; a pair of ears coupleable to and forwardly extending from a first side of the backplate; and at least one plate laterally coupleable to each ear. The ears each have a proximal portion, a distal portion, and an angle portion therebetween. The proximal portions are substantially parallel and spaced laterally at a first distance. The distal portions are substantially parallel and spaced laterally at a second distance. The first distance is larger than the second distance. Each angle portion is sloped inwards towards the other and is coupled to the corresponding distal and proximal portions. A sideplate is mounted to opposite sides of the tool. A pivot pin couples the distal portion of each ear to the tool substantially at center-mass. A boom-pin couples together the proximal portions and the sideplates.

20 Claims, 12 Drawing Sheets

(56) References Cited

U.S. PATENT DOCUMENTS 4,199,033 A * 4/1980 Van Gundy, Jr. ..... E02F 3/3677 173/192
4,333,250 A * 6/1982 Henderson ..... A01B 59/06 172/272
4,670,983 A * 6/1987 Ramun ..... B23D 17/06 30/134
4,836,741 A * 6/1989 St. Louis ..... E02F 3/3631 172/272
4,919,212 A * 4/1990 McClure ..... E02F 3/7613 172/274
4,966,240 A * 10/1990 Aikawa ..... E02F 9/2004 172/825
5,088,882 A * 2/1992 Lovitt, Jr. ..... E02F 3/3686 172/273
5,172,499 A * 12/1992 Griffin ..... E02F 3/40 172/245
5,183,316 A * 2/1993 Ottestad ..... E02F 3/966 299/69
5,603,382 A * 2/1997 McIver ..... A01D 87/0061 172/445.1
D395,436 S * 6/1998 Hagenbuch ..... D15/32
6,041,528 A * 3/2000 Broach ..... E02F 3/6481 37/416
6,163,989 A * 12/2000 Kaczmarski ..... E02F 3/3622 37/468
6,301,811 B1 * 10/2001 Gilmore, Jr. ..... E02F 3/3622 37/468
6,499,934 B1 12/2002 Kaczmarski et al.
6,663,338 B1 * 12/2003 Gregory, Jr. ..... A01B 59/067 37/403
6,938,514 B1 * 9/2005 Crane ..... E02F 3/3613 248/200
7,108,475 B1 * 9/2006 Gustafson ..... A01B 59/062 280/416.2
7,628,222 B2 * 12/2009 Yoshimura ..... E04G 23/082 173/162.1
7,661,210 B2 * 2/2010 Shepherd ..... E01H 5/06 172/396
8,024,875 B2 * 9/2011 Wetzel ..... E02F 3/325 37/403
D697,946 S * 1/2014 Healey ..... D15/32
D707,731 S * 6/2014 Healey ..... D15/32
9,004,845 B2 * 4/2015 Bernier ..... E02F 3/32 414/723
9,086,241 B2 * 7/2015 Bystedt ..... E02F 3/3681
9,366,005 B2 * 6/2016 Hiragakiuchi ..... E02F 3/627
9,809,945 B1 * 11/2017 Middleton ..... E02F 3/3604
2004/0040726 A1 3/2004 Foltz
2004/0168814 A1 * 9/2004 Stewart ..... B25D 17/00 173/184
2006/0070759 A1 * 4/2006 Nesseth ..... E02F 3/3672 172/817
2006/0157605 A1 * 7/2006 Ramun ..... E02F 3/302 241/266
2006/0254415 A1 * 11/2006 Miyazaki ..... E02F 9/2271 91/508
2007/0134081 A1 * 6/2007 Seabolt ..... E02F 3/08 414/723
2008/0141566 A1 * 6/2008 Esser ..... E02F 3/3631 37/468
2008/0199293 A1 * 8/2008 Santele ..... E02F 3/36 414/685
2009/0223096 A1 * 9/2009 Wimmer ..... E02F 9/2275 37/468
2014/0317967 A1 * 10/2014 Parker ..... E02F 3/325 37/403
2015/0139716 A1 * 5/2015 Schmidt ..... E02F 3/3686 403/72
2016/0356339 A1 * 12/2016 Park ..... E02F 5/326

OTHER PUBLICATIONS

Stanley MB556 Mounted Hydraulic Breaker User Manual, Safety, Operation and Maintenance, Jun. 2016 Ver. 13, http://www.stanleyhydraulics.com/sites/stanleyhydraulic.com/files/pdf/MB556%20User%20Manual%206-2016%20V13.

Stanley MB05 Mounted Hydraulic Breaker User Manual, Safety, Operation and Maintenance, Aug. 2016, Ver. 16, http://www.stanleyhydraulics.com/sites/stanleyhydraulic.com/files/pdf/MB05%20User%20Manual%208-2016%20V16_0.

Stanley MB05 Mounted Breaker, Specification Sheet, downloaded from the Internet Feb. 6, 2017, http://www.stanleyhydraulics.com/sites/stanleyhydraulic.com/files/pdf/mb05-specsheet.

Stanley MB Series Specifications, Mounted Carrier Attachments V2, downloaded from the Internet Feb. 6, 2017, http://www.stanleyhydraulics.com/sites/stanleyhydraulic.com/files/pdf/MB%20Series%20Sheet%20v2.

Stanley MBX15 Hydraulic Mounted Breaker User Manual, May 2016, Ver. 8, http://www.stanleyhydraulics.com/sites/stanleyhydraulic.com/files/pdf/MBX15%20User%20Manual%20English%205-2016%20V8.

Stanley MB256 Mounted Hydraulic Breaker User Manual, Safety, Operation and Maintenance, Oct. 2016, Ver. 38, http://www.stanleyhydraulics.com/sites/stanleyhydraulic.com/files/pdf/MB256%20User%20Manual%2010-2016%20V38.

Stanley MB156 Mounted Hydraulic Breaker User Manual, Safety, Operation and Maintenance, Jun. 2016, Ver. 17, http://www.stanleyhydraulics.com/sites/stanleyhydraulic.com/files/pdf/MB156%20User%20Manual%206-2016%20v17.

International Search Report and Written Opinion of the International Searching Authority in corresponding International Application No. PCT/US2018/015959 dated May 15, 2018.

* cited by examiner

TOOL-TO-CARRIER CRADLE ASSEMBLY

FIELD

The present disclosure relates to a tool-to-carrier cradle assembly for attachment of the tool to a carrier.

BACKGROUND

This section provides background information related to the present disclosure which is not necessarily prior art.

Tool-to-carrier cradles are used to mount robust hydraulic tools to a carrier or prime mover. Mounting tools like a hydraulic breaker requires the tool-to-carrier cradle to be able to counteract significant forces. In order to provide the necessary robustness, existing tool-to-carrier cradle products are generally expensive to manufacture. For example, such tool-to-carrier cradles typically require significant material in the form of relatively thick metal plates. Alternatively or additionally, such tool-to-carrier cradles typically require providing multiple horizontal bends at or close to 90 degrees in the metal plates. Additionally, some require multiple tool-to-carrier cradles to accommodate different tool angles, further adding to the costs. The present disclosure provides a tool-to-carrier cradle assembly that eliminates one or more of these generally seen problems.

SUMMARY

This section provides a general summary of the disclosure, and is not a comprehensive disclosure of its full scope or all of its features.

According to an aspect of the present disclosure, a tool-to-carrier cradle assembly is provided for coupling a tool to a carrier having upper and lower carrier couplings. The tool-to-carrier cradle includes a backplate; a pair of forwardly extending ears; a first plate laterally coupled to the first ear; and a second plate laterally coupled to the second ear. The backplate has a first side and a second side. The ears extend from the first side of the backplate. The second side of the backplate includes upper and lower backplate couplings coupleable to the upper and lower carrier couplings. The ears each have a proximal portion, a distal portion, and an angle portion therebetween. The proximal portion of each ear is coupled to the first side of the backplate. The proximal portion of the first ear is substantially parallel and spaced laterally from the proximal portion of the second ear at a first distance. The distal portion of the first ear is substantially parallel and spaced laterally from the distal portion of the second ear at a second distance. The first distance between the proximal portions is larger than the second distance between the distal portions. The angle portion has a first end and a second end. The first end of each angle portion is coupled to the corresponding proximal portion. The second end of each angle portion is coupled to the corresponding distal portion.

According to another aspect of the present disclosure, a tool and cradle assembly is provide, which is coupleable to a carrier having upper and lower carrier couplings. The tool and cradle assembly includes a pair of sideplates having a proximal end and a distal end; a backplate having a first and second side; a pair of ears; a first plate laterally coupled to the first ear; and a second plate laterally coupled to the second ear. The sideplates are mounted to opposite sides of the tool. The proximal end of each sideplate includes a plurality of boom-pin apertures. The distal end of the sideplate includes a pivot aperture. The second side of the backplate includes upper and lower backplate couplings coupleable to the upper and lower carrier couplings. The ears each have a proximal portion, a distal portion, and an angle portion therebetween. The proximal portion of each ear is coupled to the first side of the backplate and includes a plurality of boom-pin apertures. The proximal portion of the first ear is substantially parallel and spaced laterally from the proximal portion of the second ear at a first distance. The distal portion of the first ear is substantially parallel and spaced laterally from the distal portion of the second ear at a second distance. The distal portion of each ear includes a pivot bushing and pin positioned to couple to the pivot aperture of the corresponding sideplate. The first distance between the proximal portions is larger than the second distance between the distal portions. The angle portion has a first end and a second end. The first end of each angle portion is coupled to the corresponding proximal portion. The second end of each angle portion is coupled to the corresponding distal portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
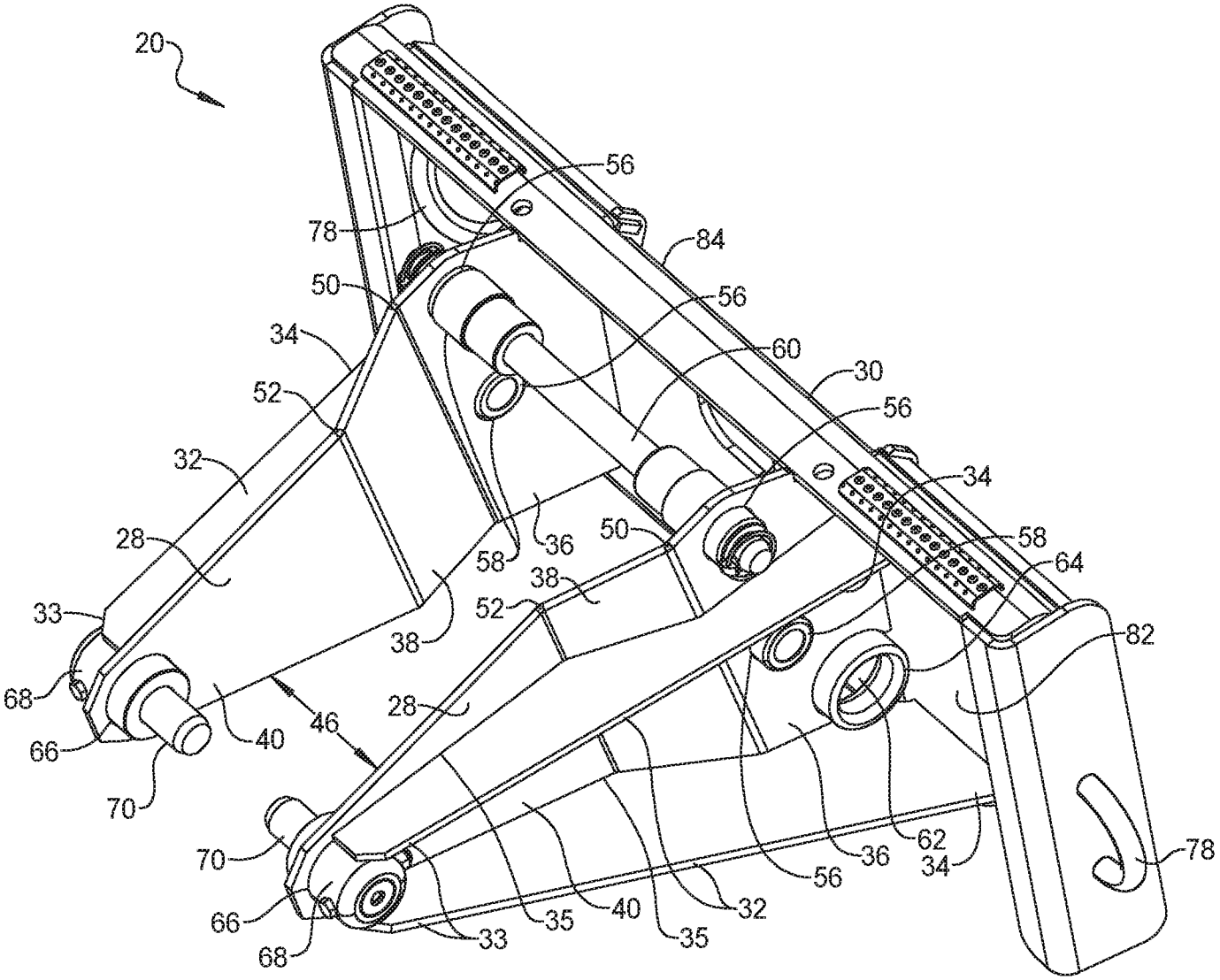
FIG. 1 is a perspective view of the tool-to-carrier cradle assembly.

Example embodiments will now be described more fully with reference to the accompanying drawings.

FIGS. 1-11 illustrate an exemplary tool-to-carrier cradle assembly 20 for attachment of an implement or tool 22 to a prime mover or carrier 26. Examples of the carrier 26 include a skidsteer, compact tool carrier, compact track loader, a compact wheel loader, or other prime movers. Typically, the carrier 26 includes one or more arms 16 carrying an attachment plate or coupling 24 at their distal ends. The carrier attachment plate 24 can include upper carrier couplings 88 and lower carrier couplings 90 (FIG. 5) for use in coupling the tool 22 to the carrier 26 via the cradle assembly 20 as described hereafter. In this way, the carrier can move and manipulate the tool 22 during operation. The carrier 26 can also be used to provide hydraulic power to the tool 22 and enable the carrier operator to additionally have operational control over the tool 22.

Figure 3:
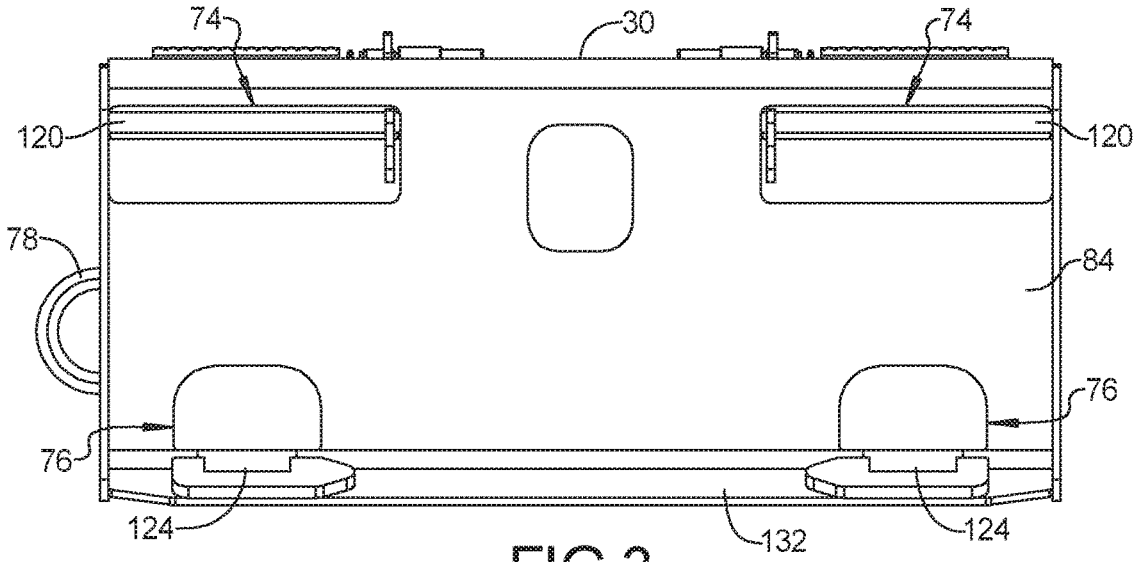
FIG. 3 is a rear-view of the backplate.
Figure 4:
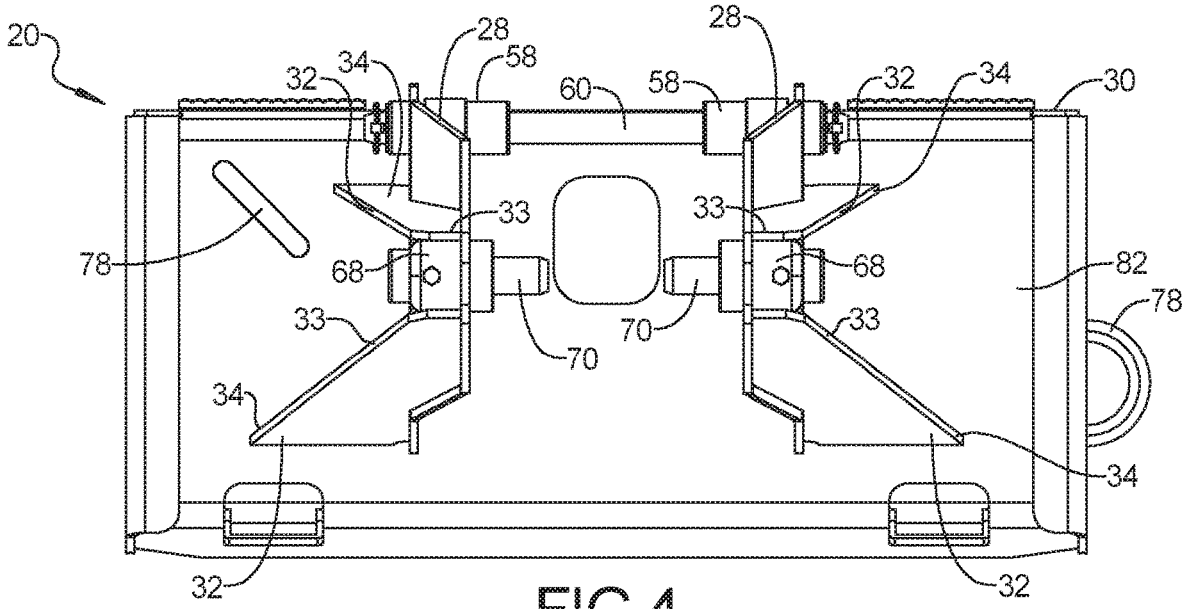
FIG. 4 is a frontal view of the tool-to-carrier cradle assembly.
Figure 5:
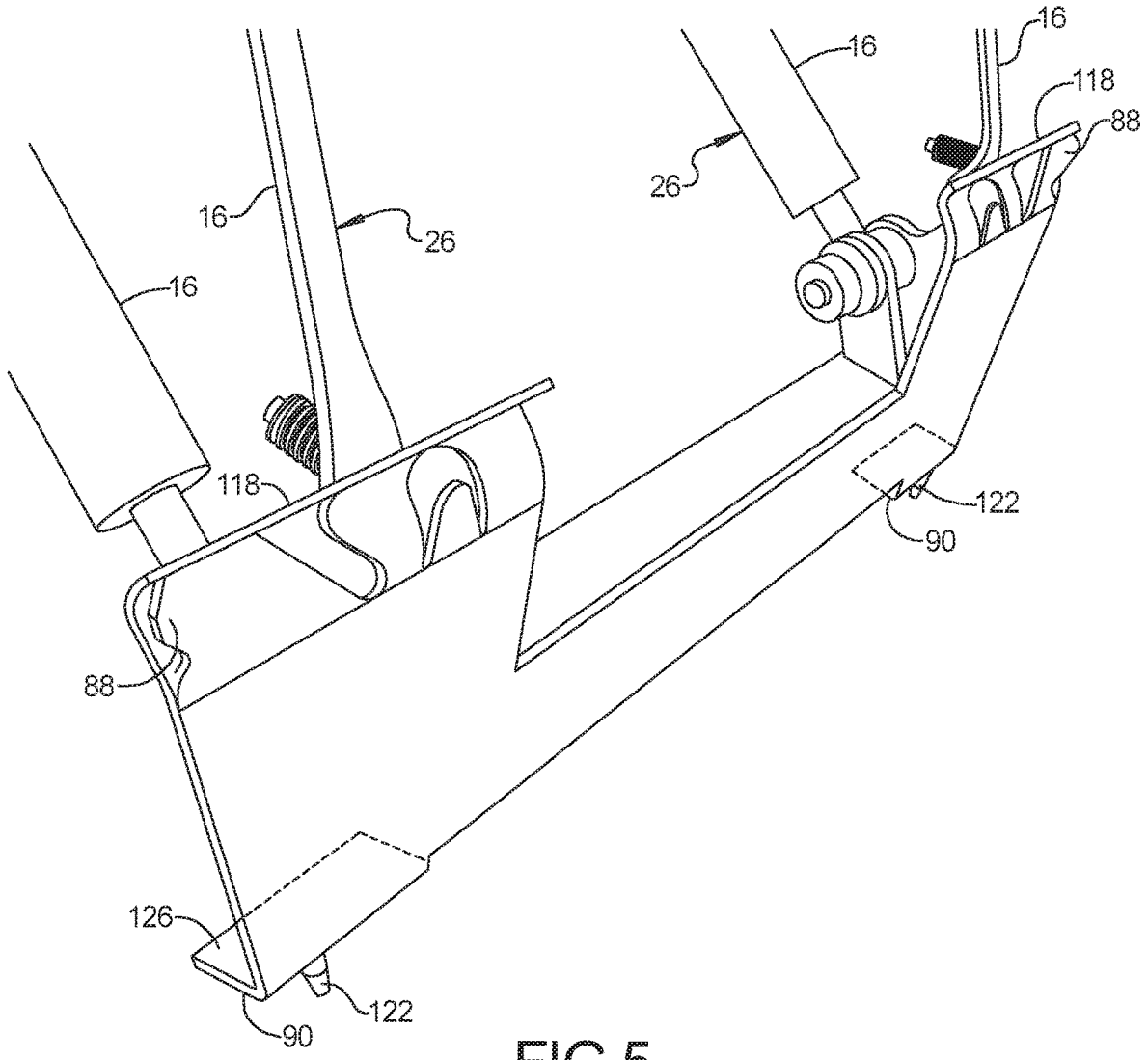
FIG. 5 is a perspective view of the carrier attachment plate.
Figure 6:
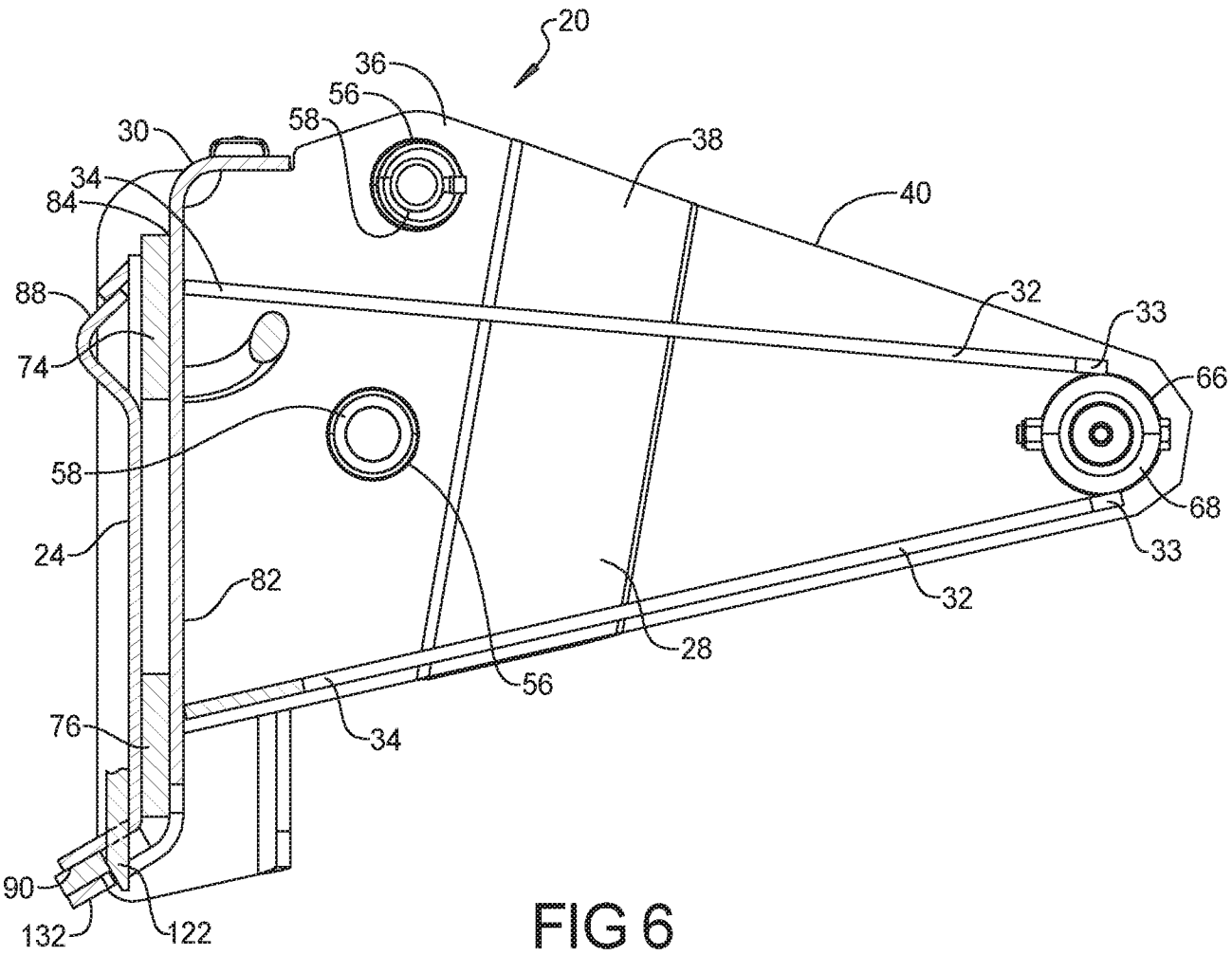
FIG. 6 is a sideview of the backplate of the tool-to-carrier cradle assembly aligned with the carrier attachment plate.

In the illustrated example, the cradle assembly 20 generally includes a backplate 30, a pair of vertical supports or ears 28, and a plurality of plates, gussets, or lateral supports 32. The backplate 30 has a front, forward, or first side 82 and a back, rear, or second side 84. As seen in FIG. 3, the rear side 84 of the backplate 30 includes upper backplate couplings 74 and lower backplate couplings 76. As seen in FIG. 6, the upper and lower backplate couplings 77 and 76, respectively, of the cradle assembly 20 are coupleable to the attachment plate 24 of the carrier 26 via the carrier's upper and lower couplings 88 and 90, respectively.

In the illustrated example, the upper couplings 88 of the carrier 26 include protrusions, projections, or flanges 118. The upper backplate couplings 74 of the cradle assembly 20 include corresponding lips 120 that form pockets for receipt of the protrusions 118 of the upper couplings 88 of the carrier 26. The lower couplings 90 of the carrier 26 include extending protrusions, projections or flanges 126 that extend rearward, backwards, or in a first direction. These lower couplings 90 of the carrier 26 can include retracting and extending pins, fasteners, or clasps 122 extending from the flanges 126. The lower backplate couplings 76 of the cradle assembly 20 can include corresponding slots, channels, or openings 124 in a protrusion, projection, or flange 132 that extends rearward, backwards, or in a first direction into which the pins 122 can be received.

Figure 2:
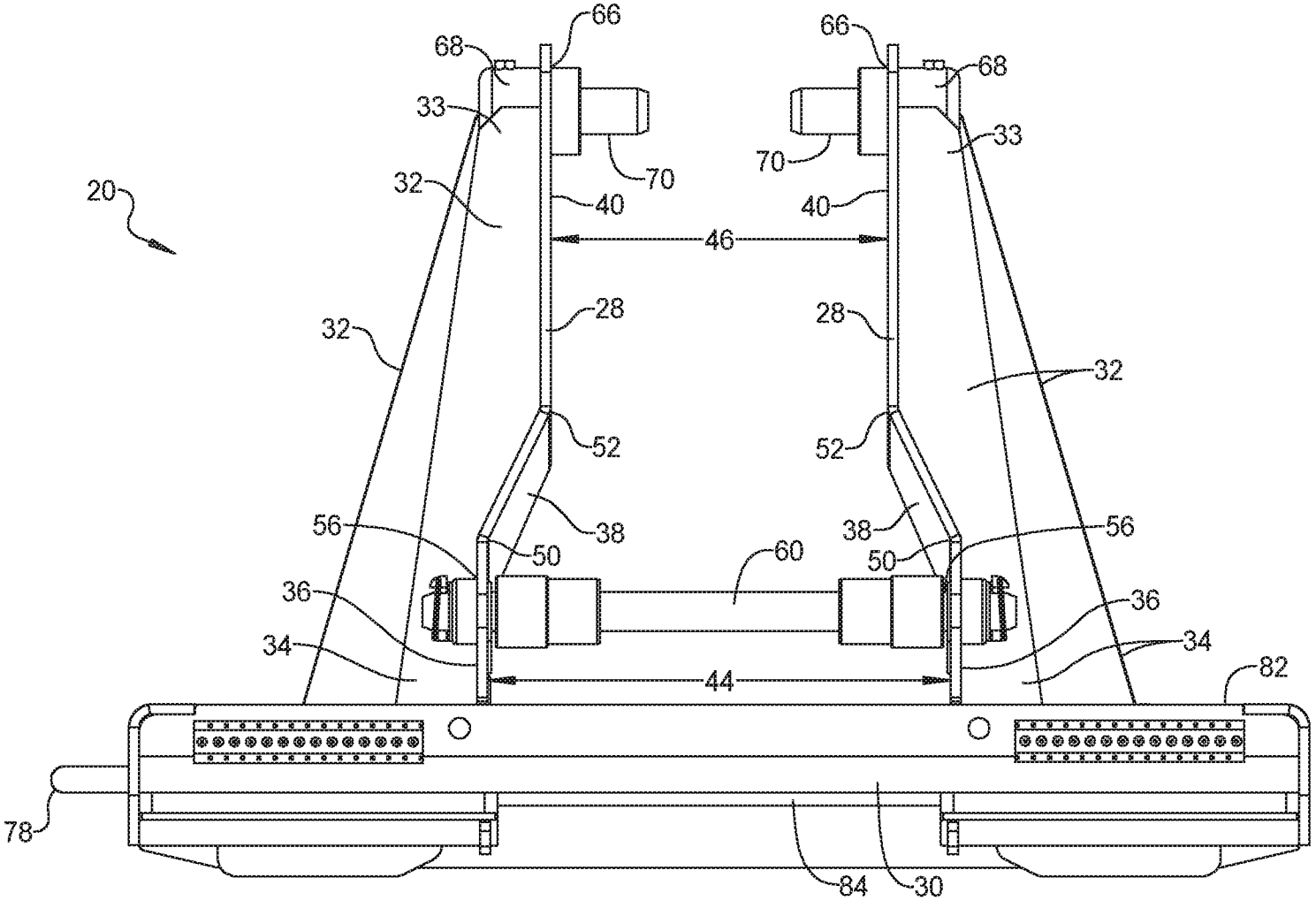
FIG. 2 is a top-down view of the tool-to-carrier cradle assembly.

As seen in FIG. 2, the ears 28 of the example cradle assembly 20 are coupled to and forwardly extend from the front side 82 of the backplate. Each ear 28 can have a proximal, rear, or first portion or end 36; a distal, forward, or third portion or end 40; and an angle, intermediate, or second portion 38 extending between the proximal portion 36 and the distal portion 40. Each ear 28 can be formed from a relatively thin one-piece metal sheet that is bent along two substantially vertical axes to form the one-piece metal sheet into a shape having each of the first, second, and third portions 36, 38 and 40, respectively. In some cases, the angle of the bends 50, 52 can be less than about 20 degrees from vertical (as seen, e.g., in FIG. 6). In some other cases, the angle of the bends 50, 52 can be less than about 15 degrees from vertical. In some other cases, the angle of the bends 50, 52 can be less than about 10 degrees from vertical.

The proximal portion 36 of each ear 28 can be coupled to the front side 82 of the backplate 30. The proximal portions 36 of the ears 28 can be substantially parallel with one another. In other words, the proximal portion 36 of a left or first ear 28 can be substantially parallel with the proximal portion 36 of a right or second ear 28. The proximal portions 36 of the ears 28 can be laterally spaced with respect to one another. Thus, the proximal portion 36 of the left ear 28 can be spaced laterally from the proximal portion 36 of the right ear 28 at a proximal or first distance 44. In addition, the proximal portion 36 of each ear 28 can have a plurality of boom-pin apertures, holes, or openings 56. Bushings 58 can be permanently or selectively coupled to each boom-pin aperture 56. The boom-pin apertures 56 of the left ear 28 are correspondingly positioned with the boom-pin apertures 56 of the right ear 28.

Like the proximal portions 36, the distal portions 40 of the ears 28 can be substantially parallel with one another. In other words, the distal portion 40 of the left ear 28 can be substantially parallel with the distal portion 40 of the right ear 28. The distal portions 40 of the ears 28 can be laterally spaced with respect to one another. Thus, the distal portion 40 of the left ear 28 can be spaced laterally from the distal portion 40 of the right ear at a second distance 46. The second distance 46 between the corresponding distal portions 40 of the ears 28 can be smaller than the first distance 44 between the corresponding proximal portions 36 of the ears 28. The distal portion 40 of each ear 28 can have a pivot aperture, hole, or opening 66 and bushings 68 can be permanently or selectively coupled to each pivot aperture 66.

The angle portions 38 of the ears 28 can each be sloped inwards towards the corresponding angle portion 38. In other words, the angle portion 38 of the left ear 28 can be sloped inwards towards the angle portion 38 of the right ear 28, and conversely, the angle portion 38 of the right ear 28 can be sloped inwards towards the angle portion 38 of the left ear 28. In some cases, the angle portions 38 can be sloped at an inside or interior angle, relative to the corresponding proximal portions 36, that is from about 10 degrees to about 80 degrees. In some other cases, the angle portions 38 can be sloped at an inside or interior angle, relative to the corresponding proximal portions 36, that is from about 25 degrees to about 50 degrees. In some other cases, the angle portion 38 can be sloped at an inside or interior angle, relative to the corresponding proximal portions 36, that is from about 55 degrees to about 75 degrees.

As mentioned above, each ear 28 of the illustrated example of the cradle assembly 20 is formed from a relatively thin one-piece metal sheet. Thus, each ear 28 can have a proximal, rear, or first bend 50 in the one-piece metal sheet extending along a corresponding first axis wherein the proximal portion 36 and the angle portion 38 meet. Similarly, each ear 28 can have a distal, forward, or second bend 52 in the one-piece metal sheet extending along a corresponding second axis where the angle portion 38 and the distal portion 40 meet. As in the illustrated example, each of the first and second bend 50 and 52, respectively, and their corresponding first and second axes can extend, or be aligned, substantially parallel with each other and in a substantially vertical direction. The first bends 50 of the angle portions 38 can be positioned at the first distance 44. The second ends 52 of the angle portions 38 can be positioned at the second distance 46.

The plates, gussets, or lateral supports 32 are laterally coupled to the ears 28. Each of the gussets 32 can be similarly formed of a one-piece metal sheet. Each gusset 32 can be a planar member that is positioned to extend outwardly from, and substantially perpendicular to, the outer face of the attached ear 28. In the illustrated example, two gussets 32 are coupled to each ear 28. In other examples of course, additional of fewer gussets 32 can be coupled to the ears 28.

Each gusset 32 can include a proximal, rear, or first end 34 and a distal, forward, or second end 33 and an inner edge 35 extending therebetween. Each gusset 32 can be welded to the front side 82 of the backplate 30 along a proximal edge of the proximal end 34 of the gusset 32. The inner edge 35 of each gusset 32 can have a profile that matches the outer surface of the adjacent ear 28. The inner edge 35 can be welded to the adjacent ear 28 along substantially its entire length.

As in the illustrated example, the proximal end 34 of each of the gussets 32 can be aligned with, or positioned directly opposite, one of the upper or lower couplings 74, 76 of the backplate 30. Thus, when coupled to the carrier 26, the proximal ends 34 of each gusset 32 can be aligned with, or positioned directly opposite to, one of the upper or lower couplings 88, 90 of the carrier 26.

The distal end 33 of each gusset 32 can be positioned or can be extend adjacent or beside the corresponding pivot aperture 66 of the ear 28. As in the illustrated example, each pivot aperture 66 can be positioned between the distal ends 33 of two gussets 32. Thus, each gusset 32 can extend alongside the pivot aperture 66 and alongside or past each of the boom-pin aperture 56 of the ear 28 to which the gusset 32 is coupled. The gusset 32 pairs of each ear 28 can be spaced closer together at their distal ends 33 and spaced farther apart at their proximal ends 34. In other words, these gusset 32 pairs can form a V-shaped configuration.

Figure 7:
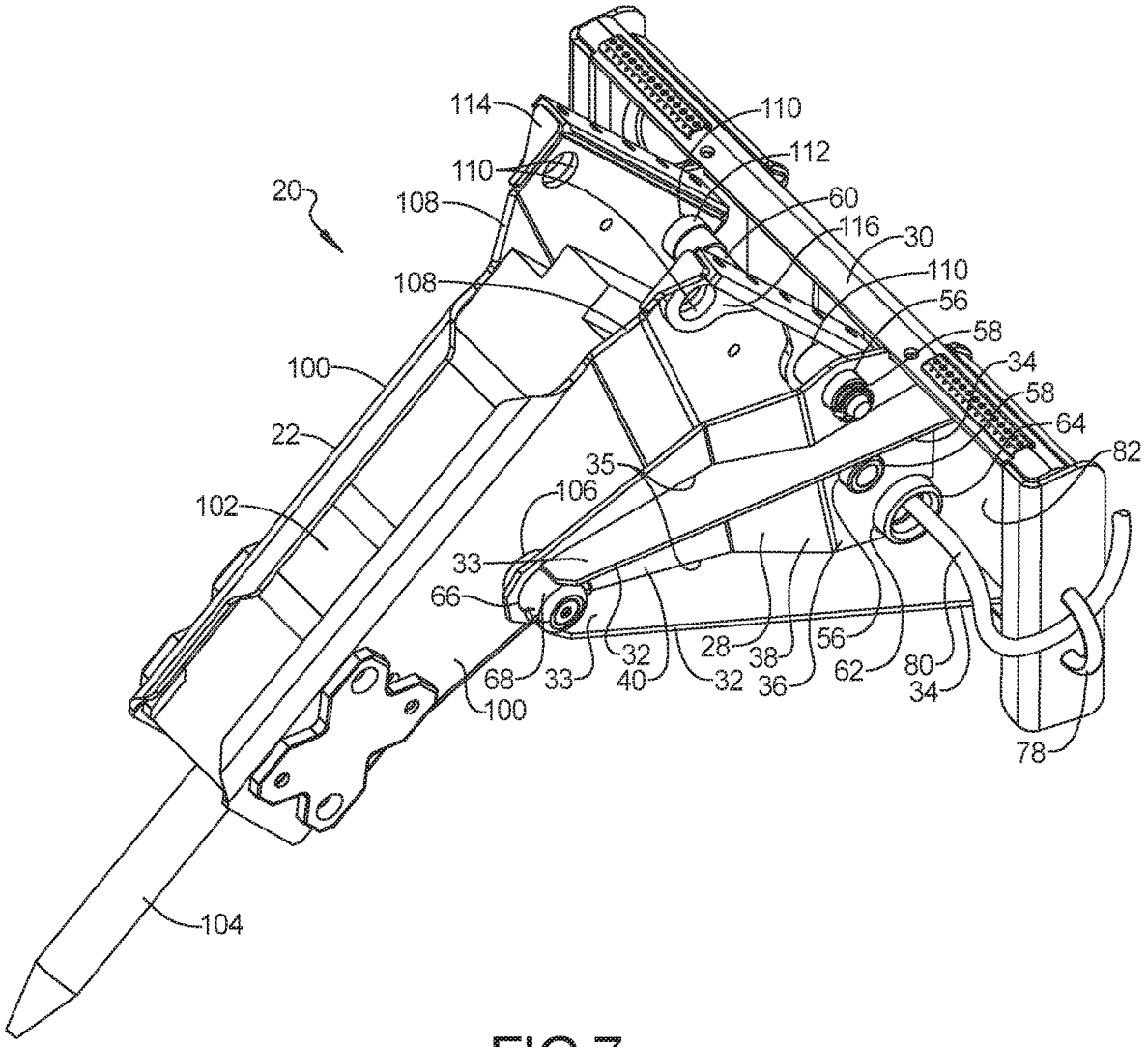
FIG. 7 is a perspective view of the tool-to-carrier cradle assembly coupled to a tool.
Figure 8:
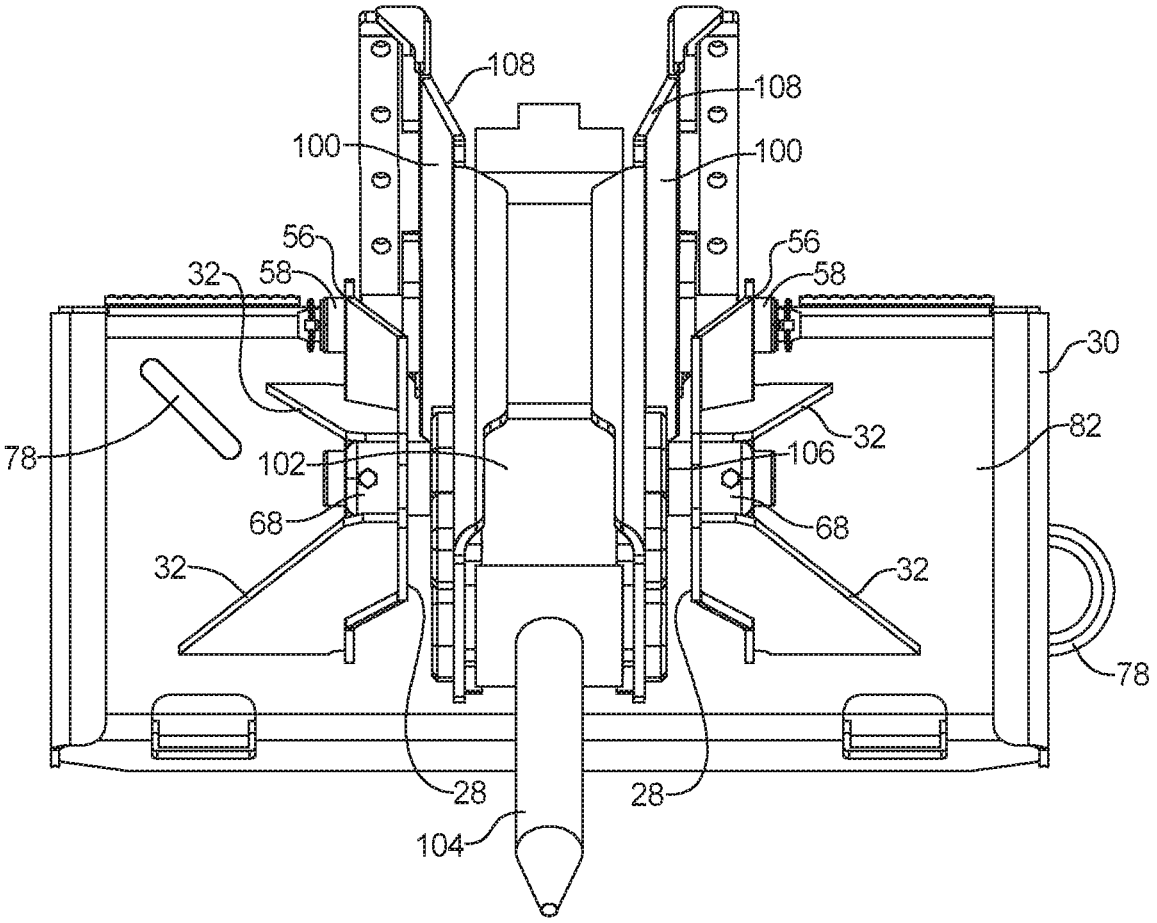
FIG. 8 is a frontal view of the tool-to-carrier cradle assembly coupled to a tool.
Figure 9:
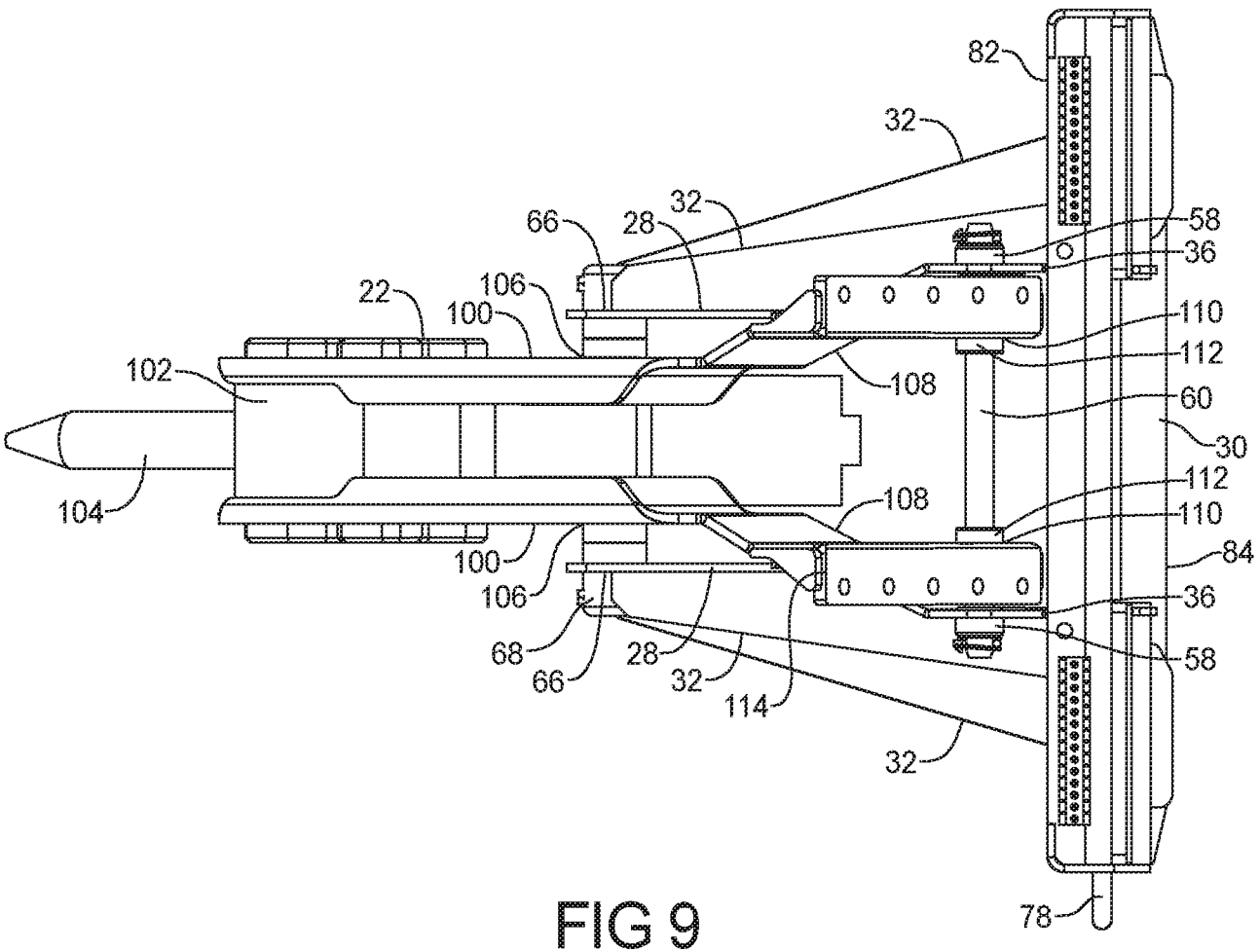
FIG. 9 is a top-down view of the tool-to-carrier cradle assembly coupled to a tool.
Figure 10:
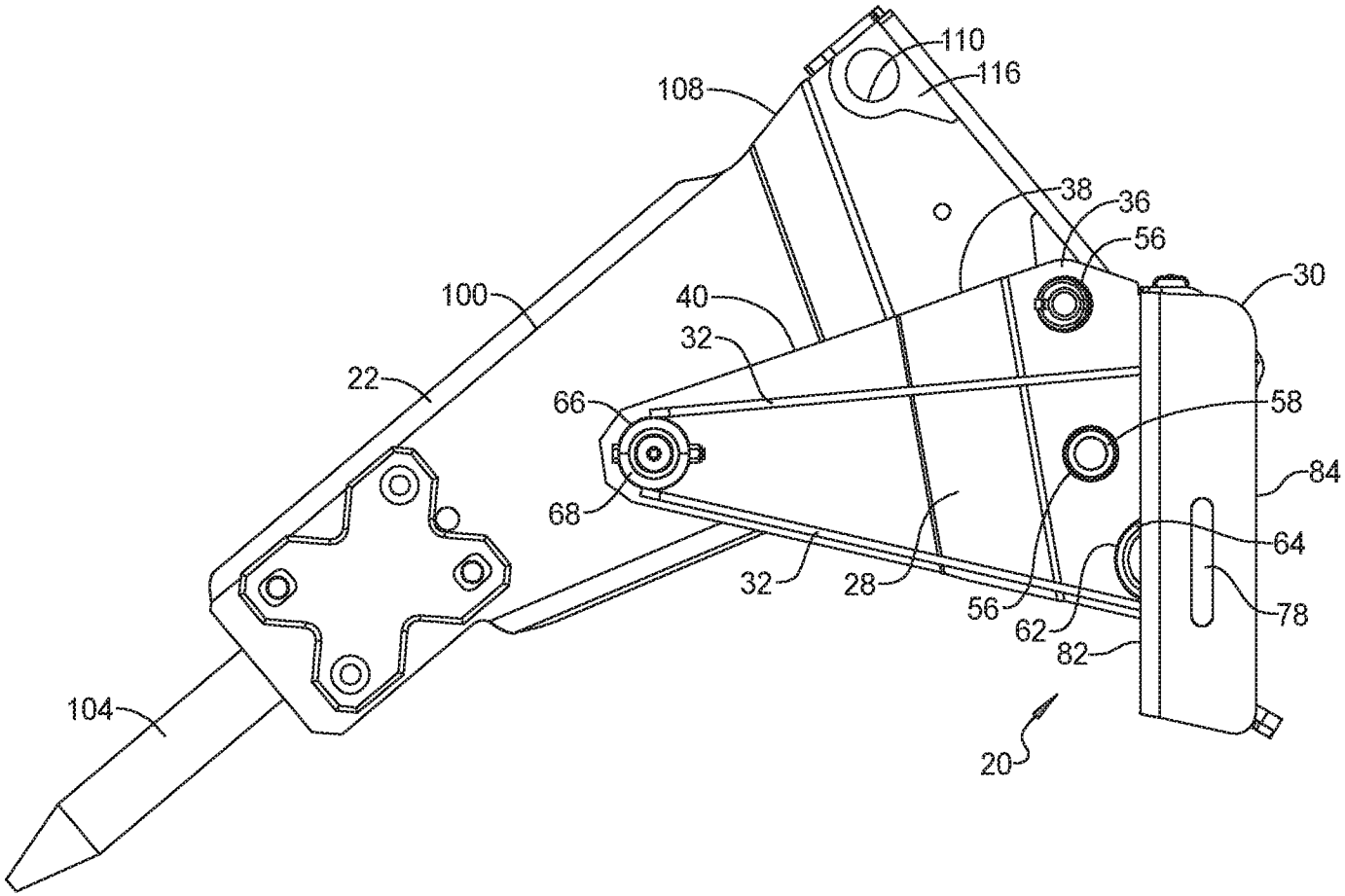
FIG. 10 is a sideview of the tool-to-carrier cradle assembly coupled to a tool, wherein the tool is positioned at a first orientation.
Figure 11:
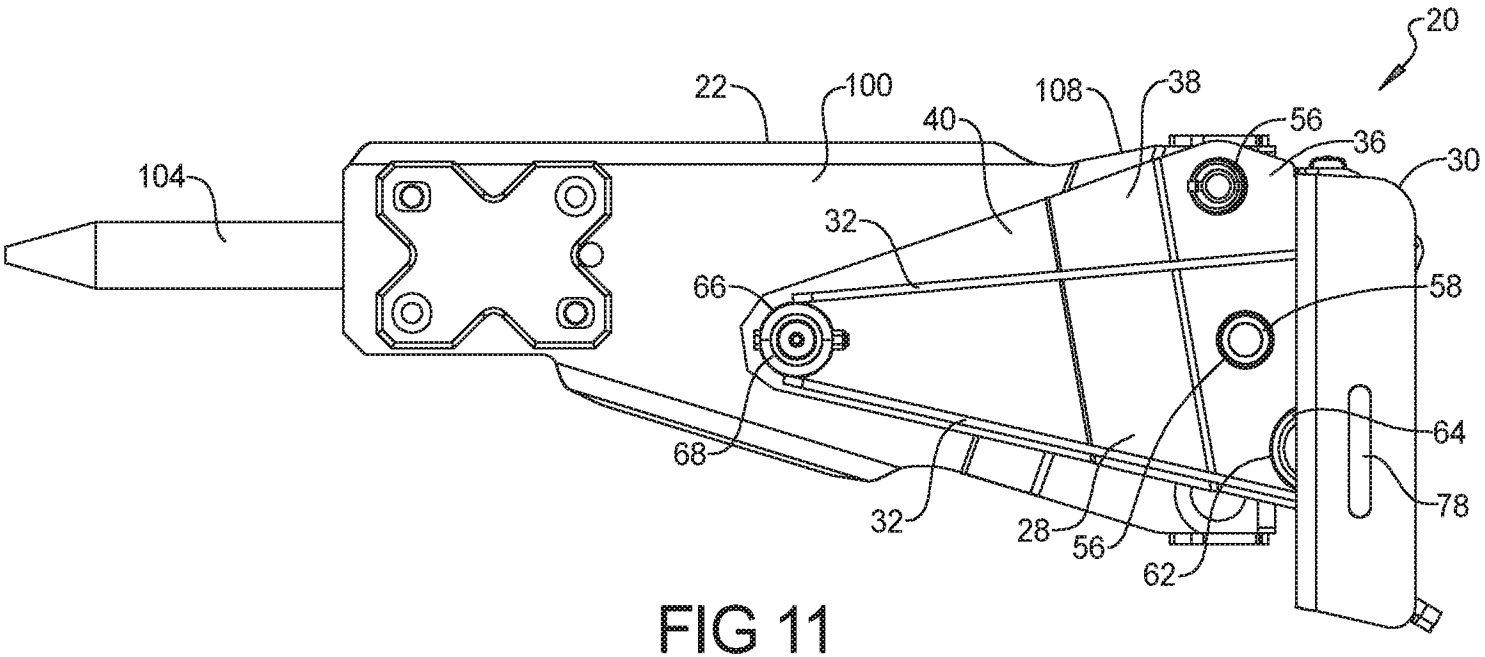
FIG. 11 is a sideview of the tool-to-carrier cradle assembly coupled to a tool, wherein the tool is positioned at a second orientation.
Figure 12:
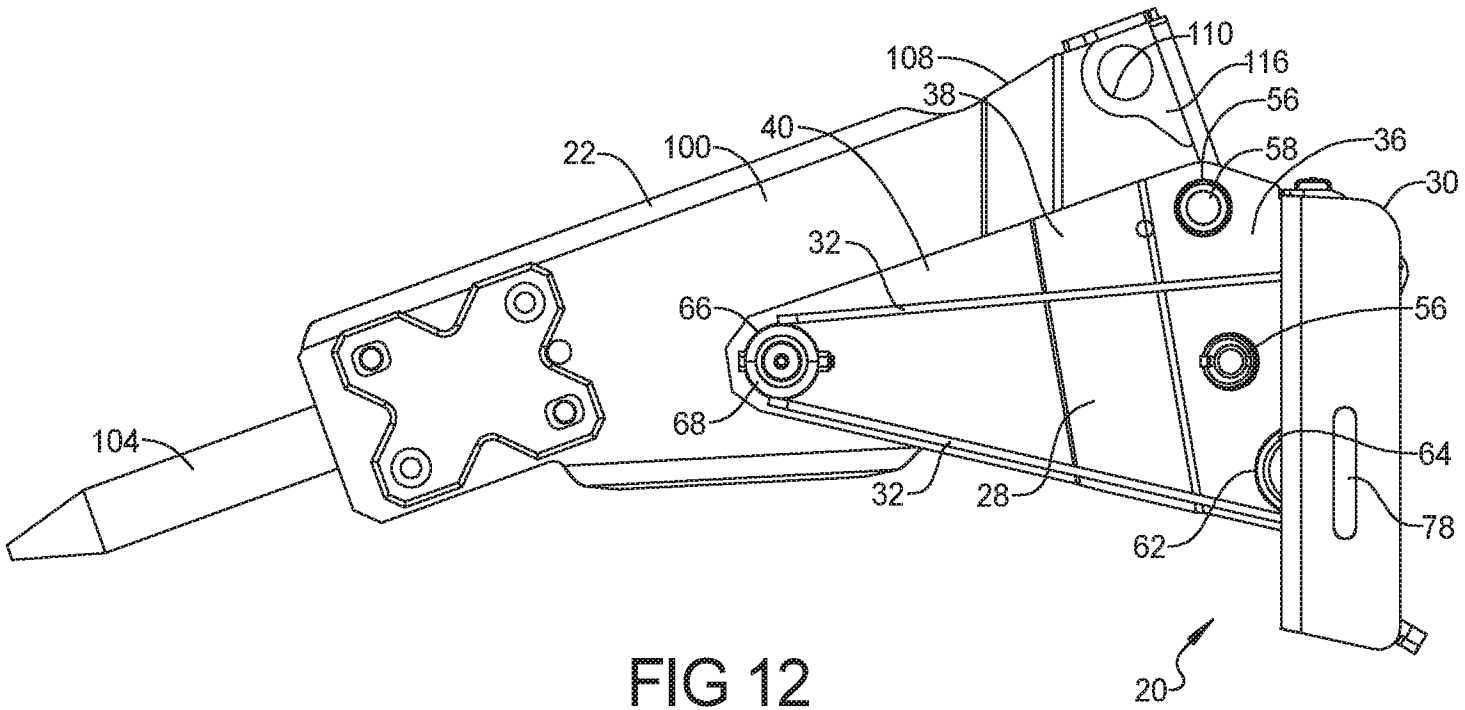
FIG. 12 is a sideview of the tool-to-carrier cradle assembly coupled to a tool, wherein the tool is positioned at a third orientation.
Figure 13:
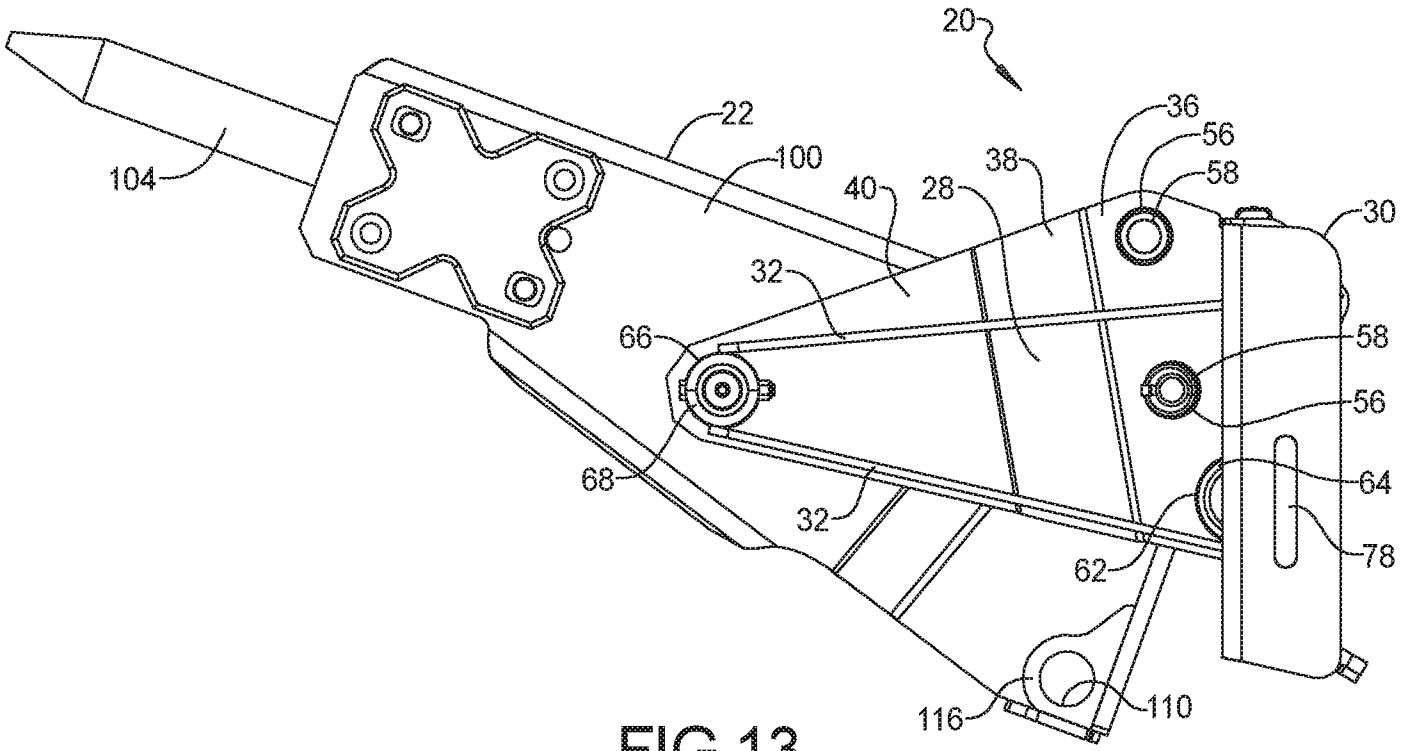
FIG. 13 is a sideview of the tool-to-carrier cradle assembly coupled to a tool, wherein the tool is positioned at a fourth orientation.

As seen in FIG. 7, the tool 22 can include a pair of sideplates or side-couplings 100. The tool can further include a powercell 102 and a toolbit 104. The tool 22 can be a hydraulic tool. The backplate 30 can include a plurality of hose loops or supports 78 to support a hydraulic supply hose 80. The ears 28 can have a hose aperture, hole, or opening 62 to support the hydraulic supply hose 80. Bushings 64 can be permanently or selectively coupled to the hose apertures 62. The tool 22 can be a hydraulic mounted breaker, a broom, a vibration plate compactor, an earth auger, a grapple rake, a specialized bucket, a concrete breaker, a cutter crusher, a trencher, or other tool.

The sideplates 100 can be positioned on opposite sides of the tool 22. Each sideplate 100 can include a proximal, rear, or first portion or end 128 and a distal, forward, or second portion or end 130. The proximal ends 128 of the sideplates 100 can include a reinforcement 108. The reinforcement 108 can include a flange portion 114 and boom-pin aperture portions 116 that surround a plurality of boom-pin apertures 110. Bushings 112 can be permanently or selectively coupled to the boom-pin apertures 110. The distal portion 130 of the sideplates 100 can include a pivot aperture 106. The pivot apertures 106 of the sideplates 100 can be positioned substantially at center-mass of the tool 22.

The boom-pin apertures 110 of the sideplates 100 can be positioned to selectively correspond with the boom-pin apertures 56 of the ears 28. A boom-pin 60 can be coupled to the corresponding boom-pin apertures 56 of the ears 28. The boom-pin 60 can be coupled to corresponding boom-pin apertures 110 of the sideplates 100. For example, as seen in FIGS. 10-13, the boom-pin 60 can be selectively positioned between the various boom-pin apertures 56 of the ears 28 and the various boom-pin apertures 110 of the sideplates 100. Movement of the boom-pin 60 between the various boom-pin apertures 56 of the ears 28 and the boom-pin apertures 110 of the sideplates 100 allows for adjustment of the orientation or height and angle of the tool 22 relative to the carrier 26. The ability to easily adjust the orientation of the tool 22 relative to the carrier 26 can allow a reduction in the resist fatigue loading from tool shocks and prying loads. The ability to easily adjust the orientation of the tool 22 relative to the carrier 26 can optimize workflow and reduce costs. The ability to easily adjust the orientation of the tool 22 relative to the carrier 26 can allow the carrier 26 to more easily maneuver while coupled to the tool 22.

The pivot apertures 106 of the sideplates 100 can be positioned to correspond with the pivot apertures 66 of the ears 28. As seen in FIG. 1, a pivot pin 70 can be coupled to the pivot aperture of each ear 28, respectfully. The corresponding pivot pins 70 coupled to each ear 28 can couple to the pivot apertures 106 of the corresponding sideplates 100. The pivot pins 70 can secure the tool 22. The difference between the first distance 44 between the corresponding proximal portions 36 of the ears 28 and the second distance 46 between the corresponding distal portions 40 of the ears 28 can allow the length of the pivot pins 70 to be reduced. The reduced length can allow the tool 22 to be supported by or about the pivot pins 70 as the boom-pin 60 is transferred between the various boom-pin apertures 56 of the ears 28 and the boom-pin apertures 110 of the sideplates 100.

The difference between the first distance 44 and the second distance 46 can allow the distance between the tool 22 and the tool-to-carrier cradle assembly 20 to be reduced. The reduced distance between the tool 22 and the tool-to-carrier cradle assembly 20 can allow the overall size of the tool-to-carrier cradle 20 to be reduced. The reduced size of the tool-to-carrier cradle 20 can improve the usability and flexibility of the carrier 26 in combination with the tool-to-carrier cradle assembly 20. The present tool-to-carrier cradle assembly 20 can also be lighter.

Although the terms, first, second, third, etc. can be used herein to describe various elements, components, regions, layers, and/or sections, these elements, components, regions, layers, and/or sections should not be limited by these terms. These terms can be only used to distinguish one element component, region, layer, or section from another region, layer, or section. Terms such as "first," "second," and other numerical terms when used herein do not imply sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," "vertical," "horizontal" and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, the terms "horizontal" and "vertical" are used in reference to the orientation of the tool-to-carrier cradle seen best in FIGS. 6 and 10-13. As another example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same can also be varied in many ways. Such variations are not to be regarded as a departure from the disclosure, and all such modifications are intended to be included within the scope of the disclosure.

What is claimed is:

1. A tool-to-carrier cradle assembly coupleable to a prime mover having upper and lower carrier couplings, the tool-to-carrier cradle assembly comprising:

a backplate having a first side facing forwardly and a second side facing rearwardly opposite the first side, the second side having upper and lower backplate couplings rearwardly extending on the second side of the backplate and coupleable to the upper and lower carrier couplings;

a pair of forwardly extending ears fixedly coupled to the first side of the backplate, each of the ears having a proximal portion, a distal portion, and an angle portion therebetween, wherein;

the proximal portions forwardly extending on the first side of the backplate are coupled to the first side of the backplate, the proximal portions are substantially parallel and are spaced laterally from each other at a first distance, the distal portions forwardly extending on the first side of the backplate are substantially parallel and are spaced laterally from each other at a second distance, wherein the distal portions are configured to be coupleable to a tool, the first distance is greater than the second distance, the angle portions forwardly extending on the first side of the backplate each have a first end and a second end, the first end of each angle portion is coupled to the corresponding proximal portion, the second end of each angle portion is coupled to the corresponding distal portion;

a first plate laterally coupled to the first ear and extending continuously over the proximal portion, the distal portion, and the angle portion of the first ear; and a second plate laterally coupled to the second ear and extending continuously over the proximal portion, the distal portion, and the angle portion of the ear.

2. The tool-to-carrier cradle assembly of claim 1, further including a third plate laterally coupled to the first ear, and a fourth plate laterally coupled to the second ear.

3. The tool-to-carrier cradle assembly of claim 1, wherein each of the first and second plates aligns with one of the upper and lower backplate couplings.

4. The tool-to-carrier cradle assembly of claim 1, wherein the first and second plates are planar and formed of one-piece metal sheet.

5. The tool-to-carrier cradle assembly of claim 1, wherein the distal portion of each ear further includes a pivot bushing and pin positioned to couple to a tool substantially at center-mass.

6. The tool-to-carrier cradle assembly of claim 5, wherein the first and second plates are coupled to the backplate and extend linearly from the backplate to adjacent the corresponding pivot bushing and pin.

7. The tool-to-carrier cradle assembly of claim 6, wherein the proximal portion of each ear further includes a plurality of boom-pin apertures, and a boom-pin extends between corresponding boom-pin apertures of the first ear and the second ear and is coupled to the tool.

8. The tool-to-carrier cradle assembly of claim 7, wherein the proximal portion of each ear further includes a hose aperture, the backplate further includes a plurality of hose loops, and the hose apertures and the hose loops are for maintaining a hydraulic supply hose from the prime mover.

9. The tool-to-carrier cradle assembly of claim 6, wherein the tool is a hydraulic tool and the prime mover is one of a skidsteer, compact too carrier, compact track loader, and compact wheel loader.

10. The tool-to-carrier cradle assembly of claim 8, wherein the tool is a hydraulic mounted breaker.

11. The tool-to-carrier cradle assembly of claim 1, wherein the first plate is positioned to extend outwardly from and substantially perpendicular to an outer face of the first ear and the second plate is positioned to extend outwardly from and substantially perpendicular to an outer face of the second ear, and wherein the outer face of the first ear faces away from an inner face of the second ear and the outer face of the second ear faces away from an inner face of the first ear.

12. A tool and cradle assembly coupleable to a prime mover having upper and lower carrier couplings, the tool and cradle assembly comprising:

a pair of sideplates configured to be mounted to opposite sides of a tool, each sideplate having a proximal end and a distal end, wherein the proximal ends include a plurality of boom-pin apertures and the distal ends include a pivot aperture;

a backplate having a first side facing forwardly and a second side facing rearwardly opposite the first side, the second side having upper and lower backplate couplings rearwardly extending on the second side of the backplate and coupleable to the upper and lower carrier couplings;

a pair of forwardly extending ears fixedly coupled to the first side of the backplate, each of the ears having a proximal portion coupled to the first side of the backplate, a distal portion, and an angle portion therebetween, wherein the proximal portions of the ears forwardly extending on the first side of the backplate are substantially parallel and are spaced laterally from each other at a first distance, the distal portions of the ears forwardly extending on the first side of the backplate are substantially parallel and are spaced laterally from each other at a second distance, the first distance is greater than the second distance, the angle portions of the ears forwardly extending on the first side of the backplate each have a first end and a second end, the first end of each angle portion is coupled to the corresponding proximal portion, the second end of each angle portion is coupled to the corresponding distal portion, the proximal portion of each ear includes a plurality of boom-pin apertures, a boom-pin extends between the corresponding boom-pin apertures of the ears and the sideplates, and the distal portion of each ear includes a pivot bushing and pin positioned to couple to the pivot aperture of the corresponding sideplate;

a first plate laterally coupled to an outer face of the first ear, wherein the outer face of the first ear is defined by a first proximal portion, a first distal portion, and a first angle portion that is disposed between the first proximal portion and the first distal portion, the first plate extends continuously over the first proximal portion, the first distal portion, and the first angle portion of the outer face of the first ear, and the outer face of the first ear faces away from an inner face of the second ear; and a second plate laterally coupled to an outer face of the second ear, wherein the outer face of the second ear is defined by a second proximal portion, a second distal portion, and a second angle portion that is disposed between the second proximal portion and the second distal portion, the second plate extends continuously over the second proximal portion, the second distal portion, and the second angle portion of the outer face of the first ear, and the outer face of the second ear faces away from an inner face of the first ear, and the inner face of the first ear faces toward the inner face of the second ear.

13. The tool and cradle assembly of claim 12, further including a third plate laterally coupled to the first ear, and a fourth plate laterally coupled to the second ear.

14. The tool and cradle assembly of claim 12, wherein each of the first and second plates aligns with one of the upper and lower backplate couplings.

15. The tool and cradle assembly of claim 12, wherein the first and second plates are planar and formed of a one-piece metal sheet.

16. The tool and cradle assembly of claim 12, wherein the first and second plates are coupled to the backplate and extend linearly form the backplate to adjacent the corresponding pivot bushing and pin.

17. The tool and cradle assembly of claim 12, wherein the pivot bushing and pin of each ear is positioned to couple to the tool substantially at center-mass.

18. The tool and cradle assembly of claim 12, wherein the proximal portion of each ear further includes a hose aperture, the backplate further includes a plurality of hose loops, and the hose apertures and the hose loops are for maintaining a hydraulic supply hose from the prime mover.

19. The tool and cradle assembly of claim 12, wherein the tool is a hydraulic tool and the prime mover is one of a skidsteer, compact tool carrier, compact track loader, and the compact wheel loader.

20. The tool and cradle assembly of claim 19, wherein the tool is a hydraulic mounted breaker.

* * * * *